US011852404B2

(12) United States Patent
Thayyullathil

(10) Patent No.: US 11,852,404 B2
(45) Date of Patent: Dec. 26, 2023

(54) REFRIGERATION APPLIANCE SYSTEM INCLUDING OBJECT IDENTIFICATION

(71) Applicant: Viking Range, LLC, Greenwood, MS (US)

(72) Inventor: Jemsheer Thayyullathil, Greenwood, MS (US)

(73) Assignee: Viking Range, LLC, Greenwood, MS (US)

( * ) Notice: Subject to any disclaimer, the term of this patent is extended or adjusted under 35 U.S.C. 154(b) by 0 days.

(21) Appl. No.: 17/119,798

(22) Filed: Dec. 11, 2020

(65) Prior Publication Data

US 2021/0180857 A1 Jun. 17, 2021

Related U.S. Application Data

(60) Provisional application No. 62/948,059, filed on Dec. 13, 2019.

(51) Int. Cl.
*F25D 29/00* (2006.01)

(52) U.S. Cl.
CPC ..... *F25D 29/00* (2013.01); *F25D 2400/361* (2013.01); *F25D 2500/06* (2013.01); *F25D 2700/06* (2013.01)

(58) Field of Classification Search
CPC ..... F25D 29/00; F25D 2400/361; F25D 2500/06; F25D 2700/06
See application file for complete search history.

(56) References Cited

U.S. PATENT DOCUMENTS

| | | | |
|---|---|---|---|
| 6,724,309 | B2 | 4/2004 | Grose et al. |
| 6,758,397 | B2 | 7/2004 | Catan |
| 6,982,640 | B2 | 1/2006 | Lindsay et al. |
| 7,040,532 | B1 | 5/2006 | Taylor et al. |
| 7,581,242 | B1 | 8/2009 | Oget et al. |
| 7,617,132 | B2 | 11/2009 | Reade et al. |
| 7,775,056 | B2 | 8/2010 | Lowentstein |
| 7,878,396 | B2 | 2/2011 | Wishnatzki et al. |
| 8,047,432 | B2 | 11/2011 | Breed |
| 8,219,466 | B2 | 7/2012 | Gui et al. |
| 8,258,943 | B2 | 9/2012 | Park et al. |
| 8,284,056 | B2 | 10/2012 | McTigue |
| 8,542,099 | B2 | 9/2013 | Pizzuto |
| 8,825,516 | B2 | 9/2014 | Grant et al. |

(Continued)

FOREIGN PATENT DOCUMENTS

| | | | |
|---|---|---|---|
| EP | 1193584 | A1 | 4/2002 |
| EP | 1962237 | A2 | 8/2008 |

(Continued)

*Primary Examiner* — Jonathan Bradford
(74) *Attorney, Agent, or Firm* — Crowell & Moring LLP

(57) ABSTRACT

A refrigeration appliance system including a camera captures images of objects entering and exiting the interior space of a refrigeration appliance and processes the images to identify the objects in the image, for example, using a trained machine learning model. The system may also process the images to determine a volume or quantity within the object. Using this determined information, the system may then create, update, or alter a log of objects within the refrigeration appliance and/or the determined volumes or quantities. The system may also provide the log and/or recommendations of items to purchase to a user.

20 Claims, 6 Drawing Sheets

(56) References Cited

U.S. PATENT DOCUMENTS

| | | | | |
|---|---|---|---|---|
| 8,878,651 | B2 | 11/2014 | Kwak | |
| 9,000,893 | B2 | 4/2015 | Kwak | |
| 9,027,840 | B2 | 5/2015 | Baarman et al. | |
| 9,194,591 | B2 | 11/2015 | Heit et al. | |
| 9,218,585 | B2 | 12/2015 | Gupta et al. | |
| 9,436,770 | B2 | 9/2016 | Hattrup et al. | |
| 9,471,862 | B2 | 10/2016 | Atkinson et al. | |
| 9,542,823 | B1 | 1/2017 | Russell et al. | |
| 9,679,310 | B1 | 6/2017 | Saltzstein et al. | |
| 9,821,344 | B2 | 11/2017 | Zsigmond et al. | |
| 9,965,798 | B1 * | 5/2018 | Vaananen | F25D 27/005 |
| 10,022,008 | B1 | 7/2018 | Staton et al. | |
| 10,117,080 | B2 | 10/2018 | Wilkinson | |
| 10,194,770 | B2 | 2/2019 | Young et al. | |
| 10,223,933 | B1 | 3/2019 | Cheng et al. | |
| 10,262,169 | B2 | 4/2019 | Omer et al. | |
| 10,395,207 | B2 | 8/2019 | Jung et al. | |
| 10,444,723 | B2 | 10/2019 | Young et al. | |
| 10,455,022 | B2 | 10/2019 | Colston | |
| 10,502,430 | B1 | 12/2019 | Alvey et al. | |
| 2004/0177011 | A1 | 9/2004 | Ramsay et al. | |
| 2009/0303052 | A1 | 12/2009 | Aklepi et al. | |
| 2013/0052616 | A1 | 2/2013 | Silverstein et al. | |
| 2013/0285795 | A1 | 10/2013 | Virtanen et al. | |
| 2014/0121810 | A1 | 5/2014 | Jung et al. | |
| 2014/0122519 | A1 | 5/2014 | Jung et al. | |
| 2014/0137587 | A1 * | 5/2014 | Hitzelberger | F25D 31/00 62/62 |
| 2015/0002660 | A1 * | 1/2015 | Lee | F25D 29/00 348/135 |
| 2015/0041537 | A1 | 2/2015 | Gentile et al. | |
| 2016/0005327 | A1 | 1/2016 | Young et al. | |
| 2016/0138860 | A1 * | 5/2016 | Kang | F25D 29/00 62/130 |
| 2016/0174748 | A1 | 6/2016 | Baldwin et al. | |
| 2016/0189174 | A1 | 6/2016 | Heath | |
| 2017/0020324 | A1 | 1/2017 | Young et al. | |
| 2018/0055270 | A1 | 3/2018 | Heimendinger et al. | |
| 2018/0093814 | A1 | 4/2018 | Espinosa | |
| 2018/0249735 | A1 | 9/2018 | Espinosa | |
| 2018/0268424 | A1 | 9/2018 | Burmeister | |
| 2018/0335252 | A1 * | 11/2018 | Oh | G06K 9/00771 |
| 2019/0053332 | A1 | 2/2019 | Cheng et al. | |
| 2019/0066034 | A1 * | 2/2019 | Giacomini | F25D 29/008 |
| 2019/0068681 | A1 | 2/2019 | Boyce et al. | |
| 2019/0104571 | A1 | 4/2019 | Clark et al. | |
| 2019/0227530 | A1 * | 7/2019 | Cerri | G05B 17/02 |
| 2019/0227537 | A1 | 7/2019 | Cella et al. | |
| 2019/0294942 | A1 | 9/2019 | Sorli et al. | |
| 2019/0303848 | A1 | 10/2019 | Schoening | |

FOREIGN PATENT DOCUMENTS

| | | |
|---|---|---|
| EP | 2988253 B1 | 8/2018 |
| WO | WO 2016193008 | 12/2016 |
| WO | WO 2017203237 | 11/2017 |

* cited by examiner

REFRIGERATION APPLIANCE SYSTEM INCLUDING OBJECT IDENTIFICATION

CROSS-REFERENCE To RELATED APPLICATIONS

This application claims priority under 35 U.S.C § 119(e) to Provisional Application No. 62/948,059, filed on Dec. 13, 2019, the entirety of which is hereby fully incorporated by reference herein.

TECHNICAL FIELD

This disclosure relates to systems and methods for object identification in refrigeration appliances.

BACKGROUND

Users of refrigeration appliances, such as commercial and consumer grade refrigerators, freezers, beverage centers, and wine chillers, often cannot recall the contents of the food or other items stored within such appliances. Such users then may purchase more or less food than is necessary, likely resulting in wasted food items. Additionally, such users may not be aware when food items have expired or have begun to decompose or rot. Such decomposition may release gases into the refrigeration appliance that cause further or accelerated ripening or rotting of other food items within the refrigeration appliance.

SUMMARY

In various embodiments, a refrigeration appliance system includes at least one camera, object identification circuitry, and appliance control circuitry. The system is configured to capture images of objects entering and exiting the interior space of a refrigeration appliance with the camera. The object identification circuitry then processes the image or images to identify the objects in the image, for example, using a trained machine learning model. The object identification circuitry may also process the images to determine a volume of a substance within the object (e.g., a volume of milk remaining in a milk container) or a quantity of sub-objects within the object (e.g., a number of apples within a paper bag). Using this determined information, the appliance control circuitry may then create, update, or alter a log of objects within the refrigeration appliance and/or the determined volumes or quantities. The appliance control circuitry may, in some embodiments, communicate the log to a user via a user interface. The appliance control circuitry may also provide recommendations of items to replace within the refrigeration appliance or indications when items may have spoiled or are nearing spoiling. Further, in some embodiments, the appliance control circuitry may alter the operation of the refrigeration appliance based on the log or based on other factors determined from the identified objects. In this manner, a refrigeration appliance is improved with the addition of features not previously available. For example, based on determinations made from object identification, the refrigeration appliance can operate in a manner that is best suited for the identified objects within the refrigeration appliance, thereby better preserving the food objects therein. Further, the refrigeration appliance system provides users with a convenient and efficient manner of managing the contents of the refrigeration appliance.

DETAILED DESCRIPTION

Figure 1:
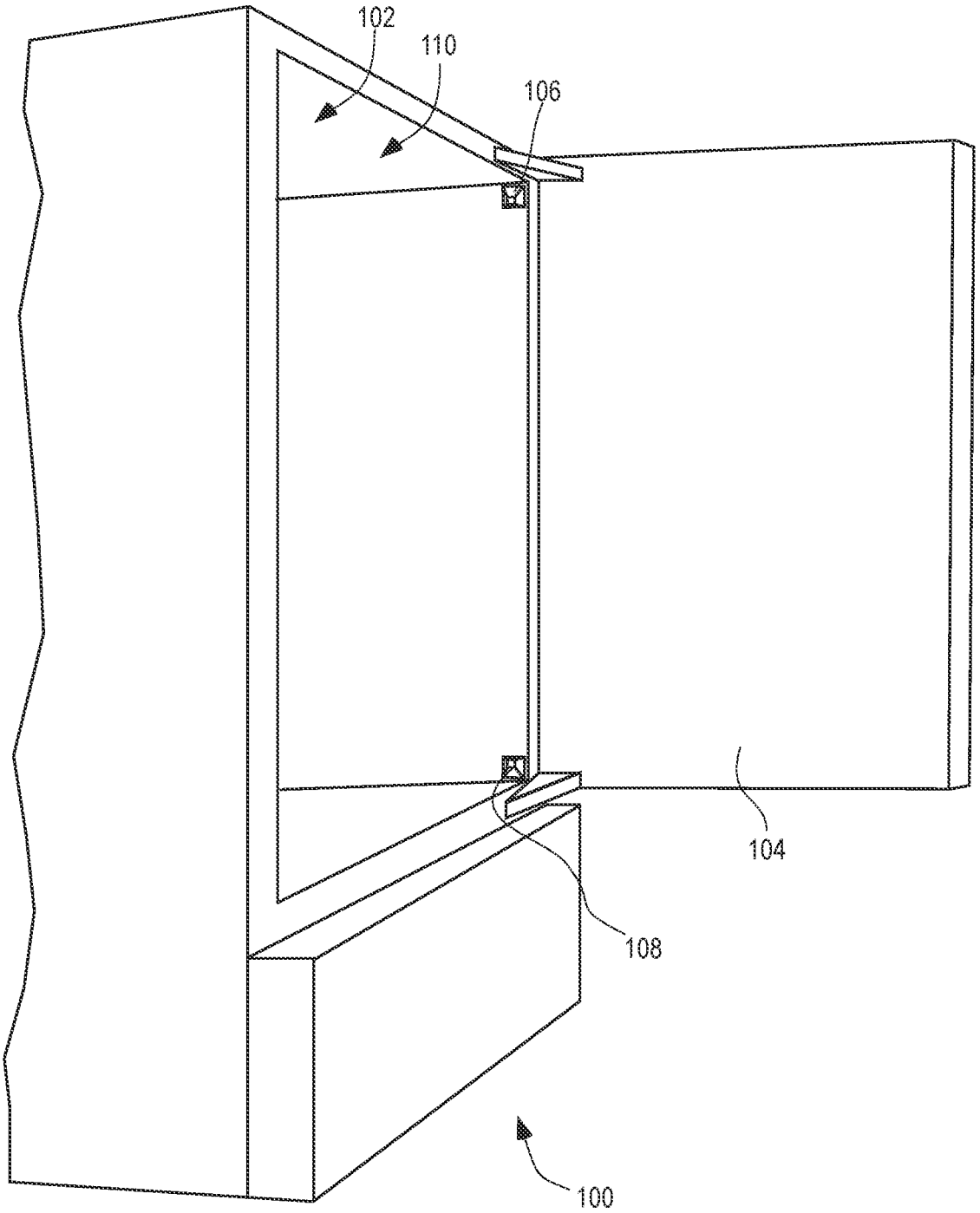
FIG. 1 shows an example refrigeration appliance of a refrigeration system according to various embodiments.

FIG. 1 shows an example refrigeration appliance 100 of a refrigeration appliance system according to various embodiments. The refrigeration appliance 100 can be a commercial or residential refrigerator, a freezer, a chiller, a beverage fridge, a wine cooler, or any other type of refrigeration appliance. The refrigeration appliance 100 includes an interior area 102 configured to store food items or other items. The refrigeration appliance 100 also includes one or more doors 104 configured to allow access to the interior area 102 of the refrigeration appliance 100. The interior area 102 and door 104 may include shelves, bins, containers, or drawers (not shown) to hold or support the food items to be stored in the refrigeration appliance 100. As is shown in FIG. 1, the refrigeration appliance 100 may include multiple zones or compartments, for example refrigeration zone and a freezer zone.

The refrigeration appliance 100 includes one or more cameras 106, 108 configured to obtain a visual image of at least a portion of an interior area 102. The one or more cameras 106, 108 are also configured so that it also captures an image of at least one object as it enters or exits the interior of the refrigeration appliance 100 (see FIGS. 4 and 6). The camera(s) 106, 108 may be placed at or near the door opening so as to capture images of objects entering or exiting the interior area 102 of the refrigeration appliance 100. In one example, the camera(s) 106, 108 are placed on an interior surface of the interior area 102 of the refrigeration appliance 100 and are oriented toward the middle of the door opening. In various approaches, the refrigeration appliance 100 includes at least two cameras 106, 108, which may be situated in various locations near the door opening, including in at least two corners of the interior area 102 near the door opening. For example, the refrigeration appliance 100 may include four cameras (e.g., including cameras 106, 108) located in the four corners of the door opening, each oriented toward the door opening to capture images that include a curtain or plane of the door opening 110 to capture images of objects that enter or exit the interior area 102. Other camera configurations and locations are possible, including cameras located within the front edges of shelves or bins, on an inner edge of the door 104 (e.g., the edge that attaches to the main body of the refrigeration appliance 100), on or in shrouds or other mounts near the door opening but existing external to the interior area 102, or other configurations. The cameras 106, 108 may have a viewing angle of at least 90 degrees in order to capture images of the entire plane of the door opening 110 (e.g., when the camera 106, 108 is placed in the corners), though other viewing angles and configurations or camera locations are possible. In some embodiments, cameras may be movable or motorized to pop out when needed and retract when not utilized, or to follow or track objects as they enter or exit the interior area 102. The cameras 106, 108 may include other features such as heaters to prevent condensation cause by temperature fluctuations when the door 104 opens. As will be discussed further below, in certain embodiments, the cameras 106, 108 may also be thermal imaging cameras (e.g., separate from or in combination with being visual imaging cameras) that are configured to capture thermal images (see FIGS. 5 and 7) of objects as they enter or exit the interior area 102.

Figure 2:
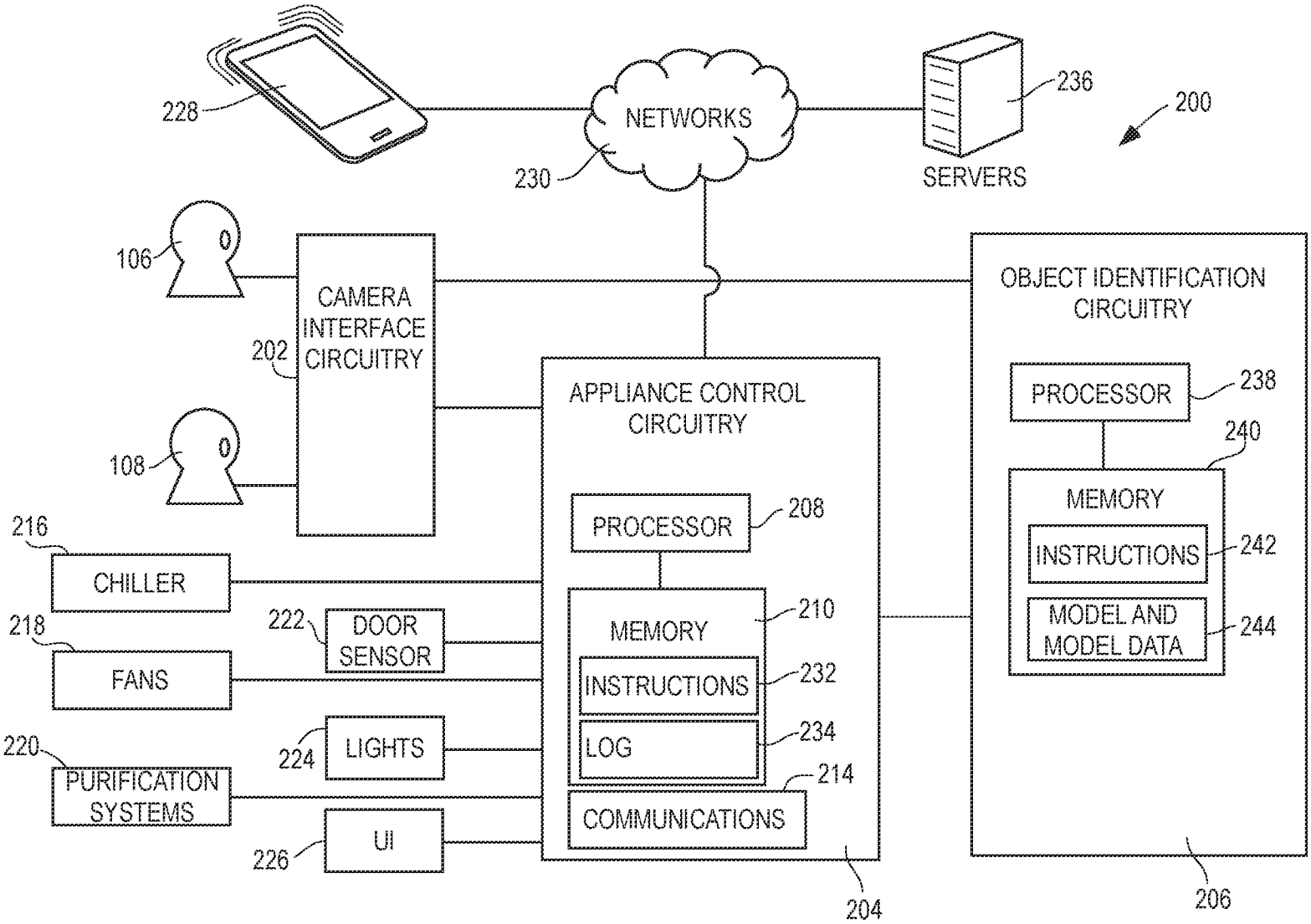
FIG. 2 shows an example block diagram of the refrigeration system in accordance with various embodiments.

FIG. 2 shows an example block diagram of the refrigeration appliance system 200 in accordance with various embodiments. The refrigeration appliance system 200 includes the refrigeration appliance 100 (not shown in FIG. 2), which also includes the cameras 106 and 108, and possibly other cameras. The cameras 106 and 108 are communicatively coupled to camera interface circuitry 202. The camera interface circuitry 202 controls the operations of the cameras 106 and 108, including capturing images and communicating with other circuitry elements within the system 200. The camera interface circuitry 202 may be communicatively coupled to the appliance control circuitry 204 and/or the object identification circuitry 206, both discussed below. Alternatively, the camera interface circuitry 202 may be included as part of the cameras 106 and 108, and the cameras 106 and 108 may be directly coupled to other circuitry elements within the system 200 such as the appliance control circuitry 204 or the object identification circuitry 206.

The appliance control circuitry 204 controls some or all operations of the refrigeration appliance 100. For example, the appliance control circuitry 204 may be connected to and control the operations of the chiller 216 or refrigeration compressor. Similarly, the appliance control circuitry 204 may be connected to and control the fan 218 to circulate air within the interior area 102. The appliance control circuitry 204 may also be connected to and control the operations of a purification system 220, such as a filtration system, which may include the use of filters and/or ultraviolet lights to remove gases (e.g., ethylene, carbon-dioxide, and methane) and odors caused by food, such as fruit and vegetables, as they ripen and begin to decompose. These gases, and particularly ethylene, can cause other foods to also ripen and begin decomposing prematurely. The purification system 220, such as the "Bluezone" purification system available from Viking, under the control of the appliance control circuitry 204, can effectively reduce such gas levels, thereby keeping food fresher longer.

The appliance control circuitry 204 may also be connected to a door sensor 222 to detect when the door 104 is opened. Items cannot enter or exit the interior area 102 of the refrigeration appliance 100 without the door 104 open. Once the door 104 opens, the door sensor 222 sends a signal to the appliance control circuitry 204 so that it may activate various devices, such as the cameras 106, 108, as well as the interior lights 224, which are also connected to the appliance control circuitry 204. Additionally, the appliance control circuitry 204 may be directly or indirectly coupled to a user interface 226. In one example, the user interface 226 is a graphical user interface presented to the user via a display screen on the refrigeration appliance 100, for example, on the exterior of the door 104. In another example, the user interface 226 is presented via a display screen on another appliance (e.g., a microwave, oven, or range) that is communicatively coupled to the refrigeration appliance 100. Further still, the user interface 226 can be presented via a mobile user device 228 that may be communicatively coupled to the appliance control circuitry 204, for example, via networks 230.

The appliance control circuitry 204 may be implemented in many different ways and in many different combinations of hardware and software. For example, the appliance control circuitry 204 may include the one or more processors 208, such as one or more Central Processing Units (CPUs), microcontrollers, or microprocessors that operate together to control the functions and operations of the refrigeration appliance 100. Similarly, the appliance control circuitry 204 may include or be implemented with an Application Specific Integrated Circuit (ASIC), Programmable Logic Device (PLD), or Field Programmable Gate Array (FPGA); or as circuitry that includes discrete logic or other circuit components, including analog circuit components, digital circuit components or both; or any combination thereof. The appliance control circuitry 204 may include discrete interconnected hardware components or may be combined on a single integrated circuit die, distributed among multiple integrated circuit dies, or implemented in a Multiple Chip Module (MCM) of multiple integrated circuit dies in a common package, as examples.

The appliance control circuitry 204 may also include one or more memories 210 or other tangible storage mediums other than a transitory signal, and may comprise a flash memory, a Random Access Memory (RAM), a Read Only Memory (ROM), an Erasable Programmable Read Only Memory (EPROM), a Hard Disk Drive (HDD), or other magnetic or optical disk; or another machine-readable non-volatile medium. The memory 210 may store therein software modules and instructions 232 that, when executed by the processor 208, cause the appliance control circuitry 204 to implement any of the processes described herein or illustrated in the drawings. The memory 210 may also store other data such as, for example, a log 234 of the food items within the refrigeration appliance 100.

The appliance control circuitry 204 may also include a communications interface 214, which may support wired or wireless communication. Example wireless communication protocols may include Bluetooth, Wi-Fi, WLAN, near field communication protocols, cellular protocols (2G, 3G, 4G, LTE/A), and/or other wireless protocols. Example wired communication protocols may include Ethernet, Gigabit Ethernet, asynchronous transfer mode protocols, passive and synchronous optical networking protocols, Data Over Cable Service Interface Specification (DOCSIS) protocols, EPOC protocols, synchronous digital hierarchy (SDH) protocols, Multimedia over coax alliance (MoCA) protocols, digital subscriber line (DSL) protocols, cable communication protocols, and/or other networks and network protocols. The communication interface 214 may be connected or configured to connect to the one or more networks 230, including the Internet or an intranet, to enable the appliance control circuitry 204 to communicate with other systems and devices, for example, with user mobile device 228 and servers 236. Additionally, the communication interface 214 may include system buses to effect intercommunication between various elements, components, and circuitry portions of the system 200. Example system bus implementations include PCIe, SATA, and IDE based buses.

The networks 230 may include any network connecting the various devices together to enable communication between the various devices. For example, the networks 230 may include the Internet, an intranet, a local area network (LAN), a virtual LAN (VLAN), or any combination thereof. The networks 230 may be wired or wireless and may implement any protocol known in the art. Specific network hardware elements required to implement the networks 230 (such as wired or wireless routers, network switches, broadcast towers, and the like) are not specifically illustrated; however, one of skill in the art recognizes that such network hardware elements and their implementation are well known and contemplated.

In various embodiments, the refrigeration appliance system 200 also includes object identification circuitry 206. Like the appliance control circuitry 204, the object identification circuitry 206 also includes one or more processors 238 connected to one or more memories 240. The memories 240 may include instructions 240 that, when executed by the processor 238, cause the object identification circuitry 204 to implement any of the processes described herein or illustrated in the drawings. The memories 240 may also store other data such as, for example, a trained machine learning model and associated data for the model 244. The servers 236 may push updates to the model 244 on a periodic or as-requested basis via the networks 230, and possibly via the communication interface 214 of the appliance control circuitry.

Although described as separate circuitry elements, the camera interface circuitry 202, the appliance control circuitry 204, and the object identification circuitry 206 may be on a single board or implemented as part of a single shared platform. These different circuitry elements may include the processors (such as processors 208 and/or processor 238) that execute instructions, memories (such as memory210 and/or memory 240) that store the instructions, software or firmware modules that are stored within the memories as instructions or other data, and any other hardware or software modules required to implement the above-described functions. Also, in various embodiments, all or a portion of the appliance control circuitry 204 and/or the object identification circuitry 206 exists remotely from the refrigeration appliance 100, for example, as part of remote servers 236 that may implement cloud computing to detect objects within images, control aspects of the refrigeration appliance 100, and interact with a user via a UI 226 (e.g., via mobile user device 228) via networks 230. The appliance control circuitry 204 and/or the object identification circuitry 206 may be included on a single circuit board, or may include multiple different boards within the refrigeration appliance 100 that intercommunicate and operate together to control some or all of the various operations of the refrigeration appliance 100. In some embodiments, portions of the appliance control circuitry 204 and/or the object identification circuitry 206 may be located at a remote location, such as server 236, and communicate with the portions of the appliance control circuitry 204 and/or the object identification circuitry 206 that are located at the refrigeration appliance 100 via networks 230.

Figure 3:
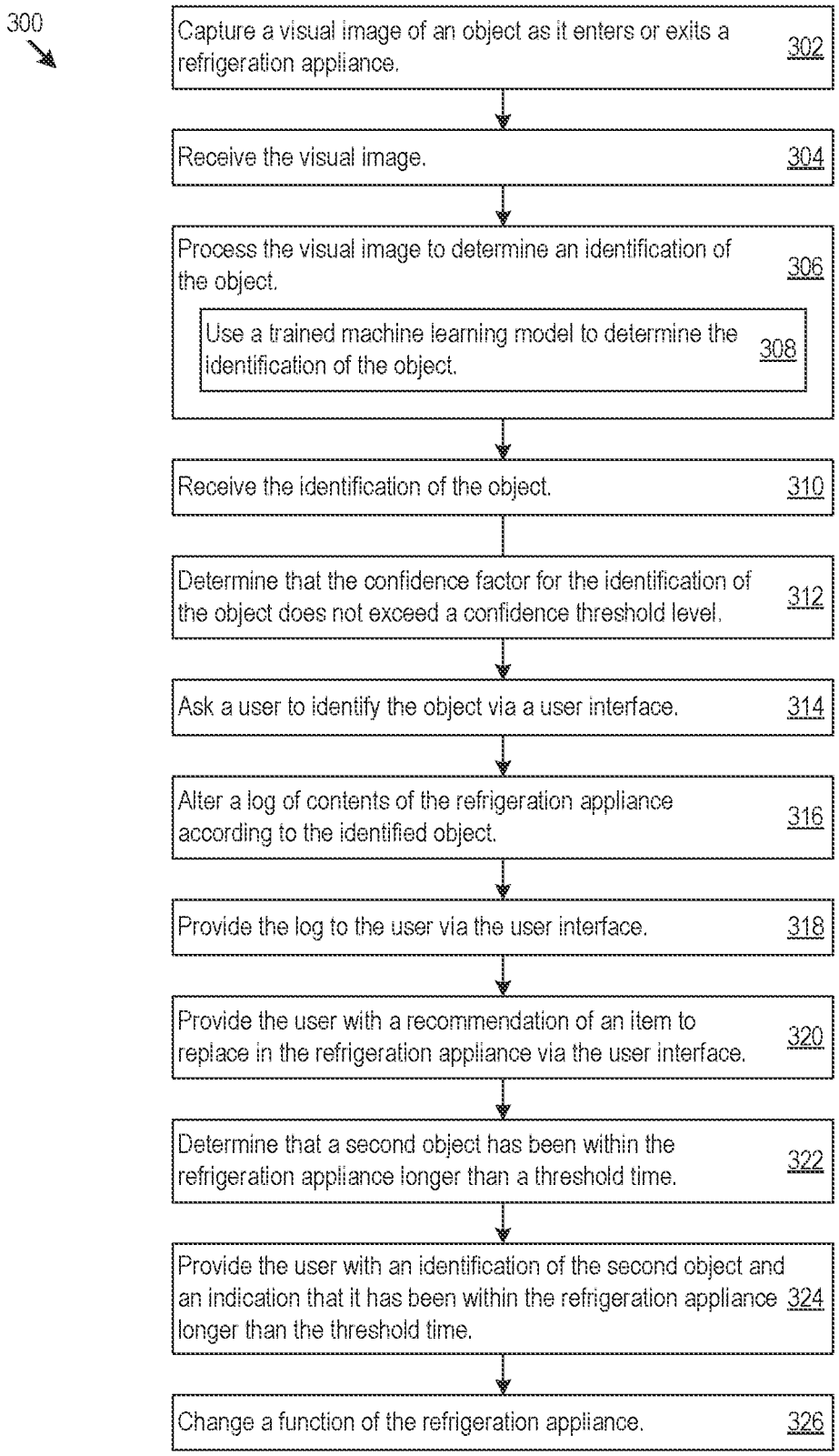
FIG. 3 shows an example flow diagram of logic that the refrigeration appliance system may implement in accordance with various embodiments.

FIG. 3 shows an example flow diagram 300 of logic that the refrigeration appliance system 200 may implement in accordance with various embodiments. In one approach, the flow diagram 300 provides a method of identifying an object in the refrigeration appliance 100. At 302, the camera (106 and/or 108) captures a visual image including at least a portion of the interior area 102 of the refrigeration appliance 100 and at least one object as it enters or exits the interior area 102 of the refrigeration appliance 100. As mentioned above, the camera may include at least two cameras 106 and 108, and in a particular embodiment, four cameras, located in some or all of the four corners of the door opening of the refrigeration appliance 100. Configured in this manner, the cameras 106 and 108 (and/or other cameras not shown in FIG. 1) capture an image including a curtain or plane of the door opening 110. Because objects can only enter and exit the interior area 102 of the refrigeration appliance 100 by crossing the plane of the door opening 110, the cameras 106 and 108 can capture images of all objects that are placed into or removed from the interior area 102.

Figure 5:
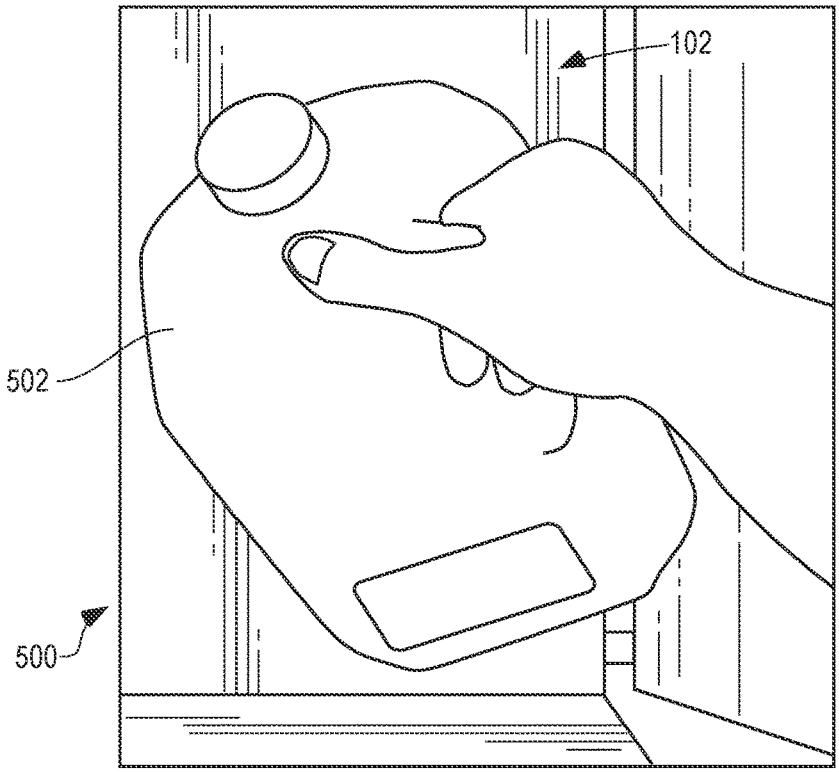
FIG. 5 shows an example image captured by the refrigeration appliance system in accordance with various embodiments.
Figure 7:
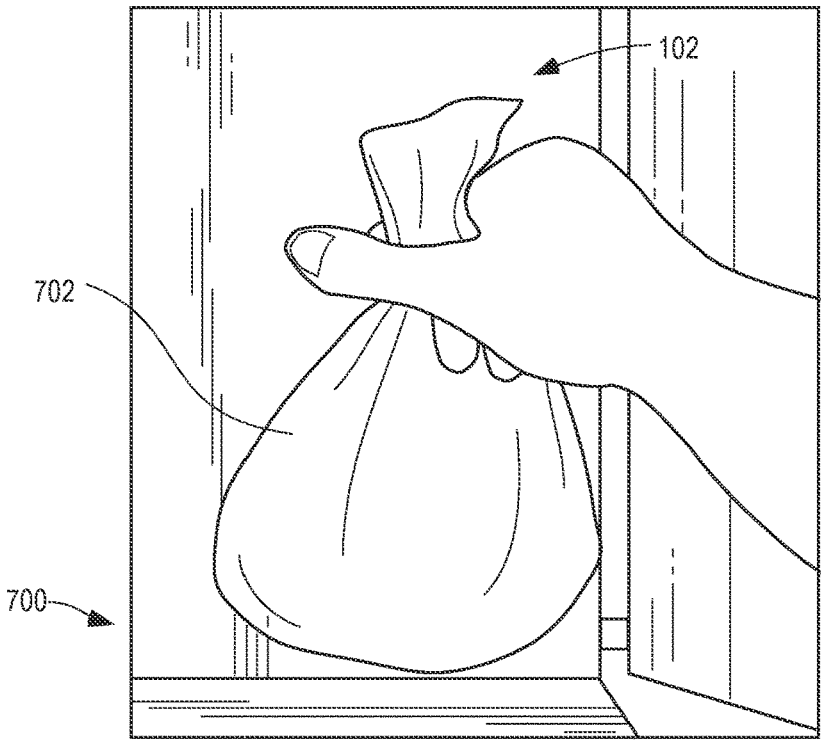
FIG. 7 shows another example image captured by the refrigeration appliance system in accordance with various embodiments.

In various embodiments, the appliance control circuitry 204 or the camera interface circuitry 202 may activate the cameras 106 and 108 in response to receiving a door open signal from the door sensor 222. The cameras 106 and 108 may begin capturing one or more images or a series of images. The camera interface circuitry 202 (or the cameras 106 and 108 themselves) may detect motion within the field of view of the camera 106 and 108 or may detect the presence of an object within the field of view of the camera 106 and 108. The camera interface circuitry 202 may then capture the image(s), for example, within temporary memory or image storage. Turning briefly to FIG. 5, an example of an image 500 captured by a camera 106 or 108 is shown. The image 500 includes at least some of the interior area 102 of the refrigeration appliance 100, and is captured essentially along the plane of the door opening 110. The object 502 is also within the image, here shown as a gallon of milk being placed into the interior area 102 of the refrigeration appliance 100. Similarly, FIG. 7 shows another example of an image 700 capture by the camera 106 or 108. A different object 702 is within the image 700, here shown as a sack or bag containing some unknown sub-object.

Once captured, the camera interface circuitry 202 may then communicate the image(s) to the object identification circuitry 206 either directly or via the appliance control circuitry 204 to be processed to determine the identification of the detected object within the image. As stated above, the object identification circuitry 206 may be directly part of the refrigeration appliance 100, or may be located remotely at servers 236 such that the image(s) are communicated to the object identification circuitry 206 via communication interface 214 and networks 230. At 304, the object identification circuitry 206 receives the image(s).

In some embodiments, the camera interface circuitry 202 or the object identification circuitry 206 may capture and process a series of images to determine the direction of movement of the object to determine whether the object is being placed into or removed from the interior are 102 of the refrigeration appliance 100. This information is subsequently used by the appliance control circuitry 204 to update the log 234 of items within the refrigeration appliance 100 based on whether an identified object was removed or placed into the refrigeration appliance 100.

At 306, the object identification circuitry 206 processes the image(s) to determine the identification of the object in the image(s). In certain examples, the object identification circuitry 206 scans for UPC barcodes, QR codes, or other identifying image-based codes that may exist on an object or label of the object that serve to identify the object. The object identification circuitry 206 may then cross-reference the scanned code against a database of known codes to help identify the object. Similarly, the object identification circuitry 206 may scan for text on the object ad perform optical character recognition (OCR) processing on the text. The object identification circuitry 206 may then cross-reference any recognized text against a database of known text of products to identify the object in the image(s).

In another approach, which may be implemented in addition to those discussed above, at 308, the object identification circuitry 206 uses an analytical model, such as a trained machine learning model (ML model), to determine the identification of the object in the image(s). The object identification circuitry 206 processes the image data with the trained ML model, which then produces one or more possible identifications of the object in the image. Machine learning models may take many different forms, and example machine learning approaches may include linear regression, decision trees, logistic regression, Probit regression, time series, multivariate adaptive regression splines, neural networks, Multilayer Perceptron (MLP), radial basis functions, support vector machines, Naïve Bayes, and Geospatial predictive modeling, to name a few. Other known ML model types may be utilized, as well. The ML model can be trained on a set of training data. In one example, the training results in an equation and a set of coefficients which map a number of input variables (e.g., image data) to an output, being one or more candidate identifications of the object in the image.

The machine learning model may be trained with training data including images of food items, including different angles or views of those food items, along with their identification. For example, during training, the machine learning model may be provided with training data including various images of apples along with the identification of the image as including an apple. During training, the machine learning model "learns" by adjusting various coefficients and other factors such that when it is later presented with another image of an apple, the trained machine learning model can properly identify the image as including an apple.

In certain embodiments, the trained machine learning model is periodically or continuously retrained. For example, a manager of the ML model (e.g., an object identification service provider, such as a manufacturer of the refrigeration appliance) may re-train the machine learning model using images of new or different food items as they become available. Further, as is discussed below, as users of different refrigeration appliance systems 200 in the field identify objects (or confirm the identity of machine-identified objects) for the object identification circuitry 206, those refrigeration appliance systems 200 may provide the images of the user-identified objects along with their identification to the servers 236, wherein such data can be used as training data to further refine and train the machine learning model.

In one approach, the trained ML model is stored as part of the object identification circuitry 206 local to the refrigeration appliance 100. In such an approach, periodic updates to the ML model may be pushed to or requested by the object identification circuitry 206 from the servers 236 via the networks 230 and stored in the memory 240 as the stored model and model data 244. In another approach, the object identification circuity 206 is partially or wholly remote from the refrigeration appliance 100 and processing using the ML model is performed at servers 236 (e.g., in the cloud). In this cloud computing approach, any updates to the trained ML model may be implemented immediately.

In various approaches, the object identification circuitry 206, also outputs a confidence factor associated with the one or more identifications. For example, if an image including an apple is provided to the object identification circuitry 206, the object identification circuitry 206, using the trained machine learning model, may provide multiple different candidate identifications for the object in the image, each with different confidence factors. For example, the object identification circuitry 206 may identify the object as an apple with a 90% confidence factor, or an orange with a 30% factor, or a pear with a 10% factor. If the confidence factor exceeds a confidence threshold (e.g., 80%, though other thresholds may be appropriate in certain application settings), then the object identification circuitry 206 or the appliance control circuitry 204 may determine that the identification of the object is the correct identification.

In some embodiments, the object identification circuity may process (e.g., with the trained machine learning model) multiple images from the same camera or different cameras providing different angle views of the object as it enters or exits the interior area 102. This increases the likelihood of providing a clear and/or unobstructed image of the object to improve the proper identification of the object. Further, as the object identification circuitry 206 processes multiple images (e.g., with the trained machine learning model) and multiple candidate identifications are provided for the object in the images, the object identification circuitry 206 can determine which candidate identification is the proper one. In one example, the object identification circuitry 206 may determine which candidate identification is most repeated across the different images of the object. For example, if the object identification circuitry 206 processes four images of the object from four different cameras, and the processing of three out of four images results in the object being identified as an apple, then there is a high likelihood that the object is indeed an apple.

In some embodiments, the object identification circuitry 206 may communicate with grocery stores or other grocery services to receive a list of items purchased. The object identification circuitry 206 may then cross-reference candidate identifications of objects against the received list of items purchased. For example, if the object identification circuitry 206 identifies an object as being either an apple or an orange, the object identification circuitry 206 can review the list of items purchased to see that apples were purchased, but not oranges. The object identification circuitry 206 may then increase the confidence factor for an identification of the object as an apple and may likewise reduce the confidence factor for the identification of orange. Additionally, the appliance control circuitry 204 may receive information regarding when items the user typically purchases go on sale or when certain items that have been purchased may have been recalled.

At 310, the appliance control circuitry 204 may receive the identification of the object from the object identification circuitry 206. In certain embodiments, the appliance control circuitry 204 may also receive an associated confidence factor associated with the identification of the object from the object identification circuitry 206. As mentioned above, if the appliance control circuitry 204 or the object identification circuitry 206 determines that the confidence factor equals or exceeds the confidence threshold level, then the appliance control circuitry 204 or the object identification circuitry 206 may determine that the identification is the proper one for the object and may proceed accordingly. However, at 312, if the appliance control circuitry 204 or the object identification circuitry 206 determines that the confidence factor does not exceed (e.g., is less than) the confidence threshold level, then the appliance control circuitry 204 or the object identification circuitry 206 may ask for the identification of the object from a user.

In one approach, at 314, the appliance control circuitry 204 communicates with a user interface (UI) 226 to ask the user for the identification of the object. Similarly, the UI 226 may simply allow the user to confirm an identification of an object as was previously made by the object identification circuitry 206. As stated above, the UI 226 may be implemented as a graphical user interface, and may be provided to the user via a display panel or via the networked mobile user device 228. Similarly, the UI 226 may output audible outputs and receive audible spoken commands as inputs. In one approach, if portions of the processing are performed at servers 236 or in the cloud, then the servers 236 may communicate with the user interface (e.g., the display panel on the door or the mobile user device 228) to request the identification of the object.

In one example, the UI 226 asks the user to type, select, or speak the identification of the object (e.g., "apples") and possible the quantity or volume. In another example, the UI 226 presents a list of possible identifications for the object (e.g., apple, orange, and pear) according to the possible candidate identifications that were received from the object identification circuitry that might have been below the confidence threshold. The UI 226 may present the image(s) of the object in question to the user. The appliance control circuitry 204 may then receive a selection of the identification of the object from the user via the UI 226, for example, in the form of a touch interface input. In another embodiment, the UI 226 presents audible sounds or words that can inform the user when an object has been identified, what its identification is, when an object has not been properly identified, and an audible list of potential candidate identifications. The UI 226 may also receive vocal commands as inputs. In one approach, the UI 226 interacts with the user in real-time as the user is placing objects into or removing objects from the refrigeration appliance 100. In another approach, the UI 226 can interact with the user at a later time by presenting the image(s) of the object and asking the user to identify the object in the image or confirm a previously determined identification of that object.

By way of example, turning briefly again to FIG. 5, if the object identification circuitry 206 received the image 500, the object identification circuitry 206 would process the image 500 using the trained ML model to determine the identification of the object 502. Because the trained ML model would have been trained on images of gallons of milk, the object identification circuitry 206 would likely properly determine that the object 502 was a gallon of milk. Further, the object identification circuitry 206 would likely have a high confidence level for the identification, as well. As stated above, the appliance control circuitry 204 may ask the user via the UI 226 to confirm the identification of the object as a gallon of milk.

By way of another example, turning briefly to FIG. 7, if the object identification circuitry 206 received the image 700, the object identification circuitry 206 would process the image 700 using the trained ML model to determine the identification of the object 702. In this example, however, the object identification circuitry 206 would not be able to identify the object 702 with the trained ML model as it is an opaque sack or bag. In such an instance, the object identification circuitry 206 may ask the user via the UI to identify the object and/or identify a quantity or volume of items within the sack.

Once the object identification circuitry 206 identifies the object in the image(s), the appliance control circuitry 204 may receive the identification. At 316, the appliance control circuitry 204 may then update, alter, or create a log 234 of the items that are stored within the refrigeration appliance 100 according to the identification and whether the item entered or exited the refrigeration appliance 100. At 318, the appliance control circuitry 204 may provide the log 234 the log to a user via the UI 226, which may be via the user's mobile user device. The appliance control circuitry 204 may provide the log via a GUI, possibly in an application, an email, a text message, or another format.

At 320, in some embodiments, the appliance control circuitry 204 may also provide the user with recommendations of various food items or quantities of food items to purchase or replace within the refrigeration appliance 100. For example, the appliance control circuitry 204 may determine that the user typically keeps milk in the refrigeration appliance 100, but that there is currently no milk in the refrigeration appliance, of the volume of milk currently within the container is very low. The appliance control circuitry 204 may then provide a recommendation to the user via the UI 226 to purchase more milk.

In another example, the appliance control circuitry 204 may recognize patterns in a user's food usage or purchases and may provide recommendations accordingly. For example, the appliance control circuitry 204 may recognize that a user typically uses five apples a week and may provide a recommendation to purchase five apples. In another example, the appliance control circuitry 204 may recognize that despite typically purchasing eight apples a week, the user only uses five apples and allows three of them to perish and be thrown away. In such an instance, the appliance control circuitry 204 may provide a recommendation to the user to only purchase five apples instead of their typical purchase of eight apples. This helps the user tailor their grocery purchasing to their actual historical usage and reduces food waste.

In another example, at 322 the appliance control circuitry 204 may determine that a food items has been within the refrigeration appliance longer than a threshold time. The threshold time may be item specific (e.g., 10 days for apples, three days for fish, five days for leftovers, etc.). The threshold time may also be scanned from labels or other markings (e.g., via an OCR process) on the item identifying when it expires. At 324, the appliance control circuitry 204 may provide a notification to the user via the UI 226 of the identification of the food item and an explanation that it has been within the refrigeration appliance longer than the threshold time (e.g., that it is expired or near expiring). In such an example, as mentioned at 320, the appliance control circuitry 204 may also provide a recommendation to the user to replace the item in the refrigeration appliance.

At 326, the appliance control circuitry 204 may change a function of the refrigeration appliance based on one or more items in the log 234. For example, if certain food items are placed into the refrigeration that fare better at colder temperatures, the appliance control circuitry 204 may control the chiller 216 or compressor to run the refrigeration temperature colder. Similarly, if the log 234 indicates that certain produce items have been in the refrigeration appliance for an extended time, the appliance control circuitry 204 may increase the operation of the purification system 220.

In certain embodiments, the appliance control circuitry 204 may provide a recommendation of a location in the refrigeration appliance in which to store a food item once it is identified. In some approaches, the appliance control circuitry 204 may flash LEDs or change colors of the LEDs in a particular location or may provide an image on the UI 226 showing the user where to place a food items. For example, if the object identification circuitry 206 determines that an object is a form of produce, it may recommend to place the produce item into a particular produce crisper bin.

In some approaches, the appliance control circuitry 204 can determine the location in which a user placed the object based on an image of the interior of the refrigeration appliance.

In some embodiments, the object identification circuitry 206 can also process images of objects that are placed in storage locations within the interior area 102 of the refrigeration appliance 100. As stated above, other cameras may exist within the refrigeration appliance 100, including with the door 104, the shelves or bins, or in other locations. These cameras can also capture images of the interior area 102 as well as the items and objects located in storage locations within the interior area 102. The object identification circuitry 206 may be able to process the images of the objects within the storage location to determine when an object has expired. For example, the object identification circuitry 206 may process the images to identify the objects, and can further process those images, for example, using the same or a different trained ML model as discussed above, to determine the current status of an object. For example, the trained ML model may be trained with images of rotting or spoiled produce to enable the object identification circuitry 206 to detect when an apple or orange has begun rotting or spoiling. The appliance control circuitry 204 may then provide a notification to the user via the UI 226 that such an item has expired, possibly indicating its location within the refrigeration appliance 100.

Figure 4:
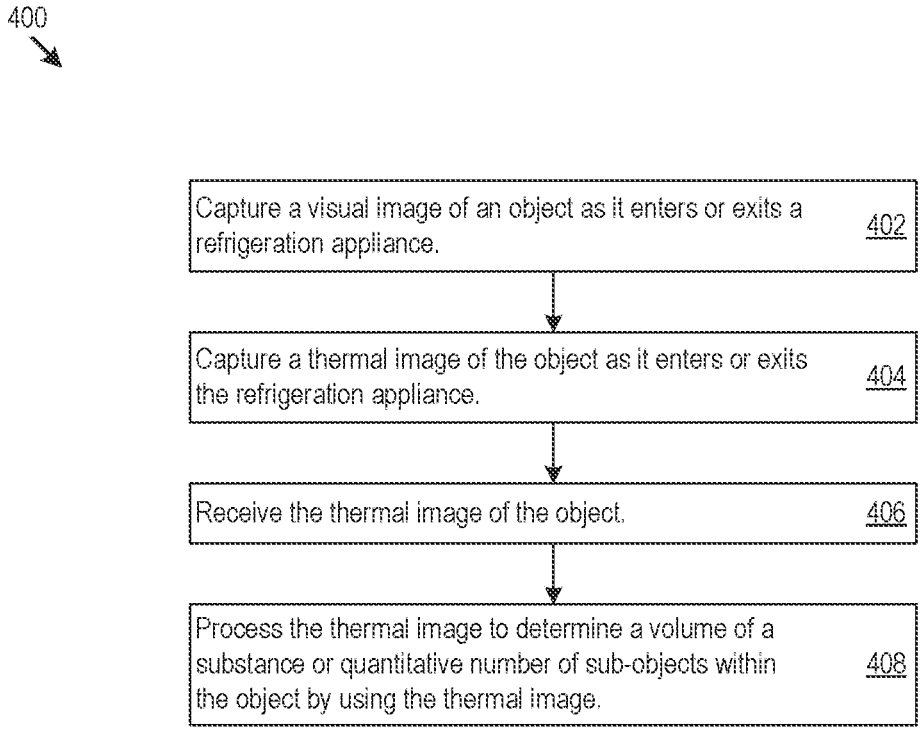
FIG. 4 shows another example flow diagram of logic that the refrigeration appliance system may implement in accordance with various embodiments.

FIG. 4 shows another example flow diagram 400 of logic that the refrigeration appliance system 200 may implement in accordance with various embodiments. At 402, the camera captures one or more visual image(s) of the object as it enters or exits the interior area 102 of the refrigeration appliance. In some embodiments, the object identification circuitry 206 can determine the volume of a substance within an object (e.g., approximate fluid ounces remaining in a gallon of milk) or a quantity of sub-objects within an object (e.g., a number of apples in a sack of apples). For example, some objects that have containers may have transparent or translucent containers (e.g., glass or plastic). The object identification circuitry 206 may be able to process the visual image(s) to determine a volume of liquid or other substance within the container by determining locations where colors or brightness changes on the object within the image(s), which may correspond to where the top of the liquid or substance exists within the container. The object identification circuitry 206 may estimate the volume based on that location on the object. The appliance control circuitry 204 may also receive this information from the object identification circuitry 206 and may update the log 234 accordingly.

However, in some embodiments, an object may include a package or container that does not allow the object identification circuitry 206 to determine the volume or quantity of items within the object. For example, as is shown in FIG. 7, an object 702 may include an opaque sack or bag (such as a paper bag) or another container that does not allow the cameras 106 or 108 to visually see its interior contents or the volume or quantity of such contents. In another common example, a paper milk or juice container may not allow the cameras 106 or 108 to visually see the volume or quantity of the interior contents. Such issues prevent the object identification circuitry 206 from determining the volume or quantity of the contents within such containers using visual imaging.

To address this issue, in one approach the refrigeration appliance system 200 includes thermal imaging cameras, such as infrared cameras, that can capture thermal images of the object as it enters or exits the interior area 102 of the refrigeration appliance 100. The thermal imaging cameras may be separate from the cameras 106 and 108 or may be the same cameras that are configured to capture both visual and thermal images. At 404, the thermal imaging camera captures one or more thermal images of the object as it enters or exits the interior area 102 of the refrigeration appliance 100.

Figure 6:
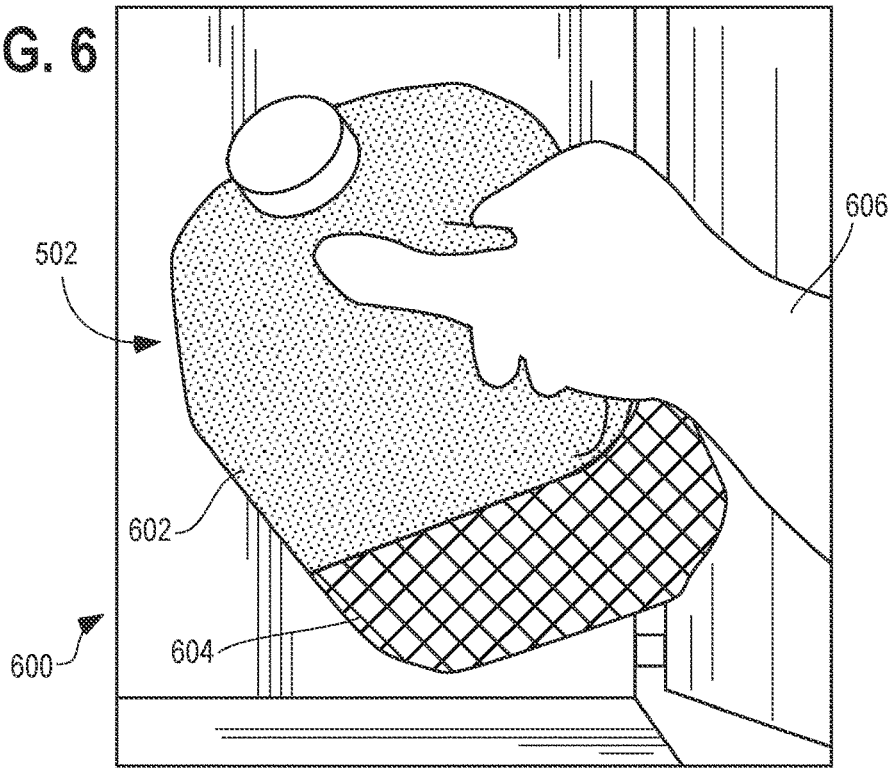
FIG. 6 shows another example image captured by the refrigeration appliance system in accordance with various embodiments.

FIG. 6 shows an example thermal image 600 captured by a thermal imaging camera in accordance with various embodiments. The thermal image 600 corresponds to the visual image 500 shown in FIG. 5, and includes the same object 502 (here, a gallon of milk). As is shown in FIG. 6, the object 502 includes different thermal zones representing different materials at different temperatures. For example, the object 502 may include air 602 within the container, which is comparatively warmer than the liquid 604 in the lower half of the container. The thermal image 600 also includes an area representing the thermal aspects of the hand and arm 606 that is holding the object 502. The thermal imaging camera can capture these distinctions in temperature that correspond to differences in the internal contents of the object 502 and within the field of view of the thermal imaging camera generally.

Figure 8:
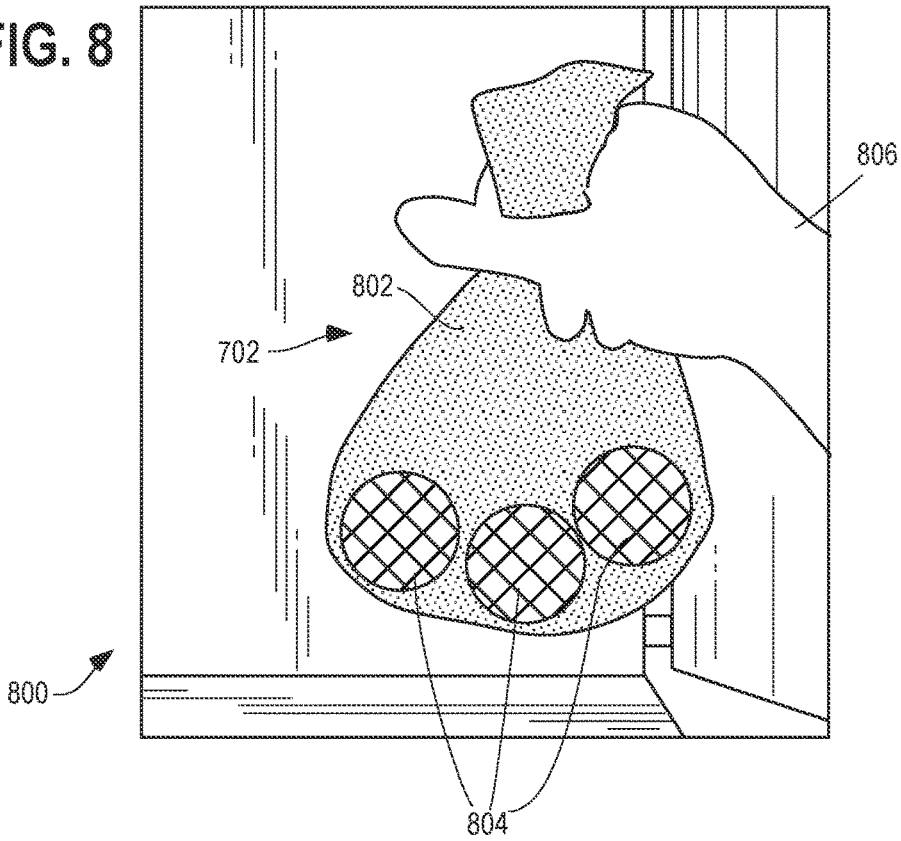
FIG. 8 shows another example image captured by the refrigeration appliance system in accordance with various embodiments.

FIG. 8 shows another example thermal image 800 captured by a thermal imaging camera in accordance with various embodiments. As with FIG. 6, the thermal image 800 corresponds to the visual image 700 shown in FIG. 7, and includes the same object 702 (here, a sack or bag). As is shown in FIG. 8, the object 702 includes different thermal zones representing different materials at different temperatures. For example, the object 702 may include air 802 within the container, which is comparatively warmer than the spherical objects 804 in the lower half of the container. The thermal image 800 also includes an area representing the thermal aspects of the hand and arm 806 that is holding the object 702. The thermal imaging camera can capture these distinctions in temperature that correspond to differences in the internal contents of the object 702 and within the field of view of the thermal imaging camera generally.

At 406, the object identification circuitry 206 subsequently receives the one or more thermal images from the thermal imaging cameras, possibly in addition to the visual images received from the cameras 106 or 108. At 408, the object identification circuitry 206 can then process these thermal images to determine or estimate the volume of a substance within the object or a quantitative number of sub-objects within the object. As with the processing of the visual images discussed above, the object identification circuitry 206 may use a trained ML model (which may be the same or different trained ML model that is used on the visual images) to determine the volume or quantity within the object. For example, with reference to FIG. 6, the object identification circuitry 206 may recognize the different thermal areas with the object 502, and recognize that border between those areas as demarking the upper border of the volume of the liquid within the object 502. The object identification circuitry 206 may then estimate the volume of liquid based, at least in part, on this recognized border.

Other factors that the object identification circuitry 206 may take into account in estimating the volume or quantity include an estimated overall size or volume of the object 502 and the shape of the object 502. The object identification circuitry 206 may estimate the overall size and shape of the object 502 from visual and/or thermal images of the object 502. In one approach, the object identification circuitry 206 uses computer vision to estimate the overall volume of the object 502 using multiple images (visual or thermal) of the object 502 taken from different angles from the different cameras 106 and 108. In another approach, if the object identification circuitry 206 can determine the identification of the object 502 (e.g., a gallon of milk) either through processing visual images with the trained ML model, by scanning UPC codes, or by text recognition of labels, the volume (e.g., one gallon) of the container of the object 502 may be already known via a database including volumes linked to identifications. With the overall volume of the container being known, as well as the location of the border of the liquid, the object identification circuitry 206 can then determine (e.g., using interpolation) the volume of liquid within the object 502.

In certain embodiments, the object identification circuitry 206 may process the thermal image together with the visual image to provide as much input data to the system to allow for an accurate estimation of the volume or quantity. For example, with reference to FIGS. 5 and 6, the object identification circuitry 206 may utilize the visual image 500 to detect the outline of the object 502 and use the thermal image 600 to detect the border of the liquid 604 within the object 502. Many other configurations are possible.

In another example, and with reference to FIG. 8, the object identification circuitry 206 can use thermal imaging to determine the quantity of sub-objects (shown in FIG. 8 as spherical objects 804) within an object 702. The object identification circuitry 206 may recognize the different thermal areas with the object 702, particularly, the air 802 within the container, which is comparatively warmer than the spherical objects 804 in the lower half of the container. The object identification circuitry 206 may then identify the multiple different spherical objects 804 and can count them, thereby providing an estimate of the quantity of sub-objects within the object 702. In certain embodiments, the object identification circuitry 206 may utilize multiple thermal images of the object 702 from the same thermal imaging camera or from different thermal imaging cameras to determine further detect the distinction between the multiple sub-objects (e.g., spherical objects 804) within the object 702. Further, the object identification circuitry 206 may make this quantity or volume determination even in the absence of a proper identification of the object 702 or the sub-objects within the object 702. For example, the object identification circuitry 206 may determine that there are three spherical objects 804 without knowing what those items are. In addition, in certain approaches, the object identification circuitry 206 can determine the shape of the sub-objects from the thermal images and determine a list of potential items that the sub-objects could be (e.g., known spherical items such as apples, oranges, or pears). The appliance control circuitry 204 may receive a list of potential items based on shape and ask the user to identify the contents, possibly providing one or more of the potential items to the user as possible selections. The appliance control circuitry 204 may receive the user's selection, as well as the volume or quantity information from the object identification circuitry 206, and may update the log 234 accordingly.

So configured, the refrigeration appliance system 200 aids users in recalling the contents and quantity of the food or other items stored within the refrigeration appliance 100. With this information, users then may purchase an appropriate amount of food, thereby reducing wasted food items and reducing grocery expenses. Further, the refrigeration appliance system 200 can inform users when food items have expired or have begun to decompose or rot, thereby reducing the release of gases into the refrigeration appliance 100 that can cause further or accelerated ripening or rotting of other food items within the refrigeration appliance. Other benefits are possible.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims. One skilled in the art will realize that a virtually unlimited number of variations to the above descriptions are possible, and that the examples and the accompanying figures are merely to illustrate one or more examples of implementations. It will be understood by those skilled in the art that various other modifications can be made, and equivalents can be substituted, without departing from claimed subject matter. Additionally, many modifications can be made to adapt a particular situation to the teachings of claimed subject matter without departing from the central concept described herein. Therefore, it is intended that claimed subject matter not be limited to the particular embodiments disclosed, but that such claimed subject matter can also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter can be practiced without these specific details. In other instances, methods, devices, or systems that would be known by one of ordinary skill have not been described in detail so as not to obscure claimed subject matter.

Various implementations have been specifically described. However, many other implementations are also possible.

What is claimed is:

1. A refrigeration appliance system comprising:

a camera configured to obtain a visual image of at least a portion of an interior of a refrigeration appliance including a plane of a door opening of the refrigeration appliance and at least one object as it enters or exits the interior of the refrigeration appliance as it passes through the plane of the door opening while a door of the refrigeration appliance is open;

object identification circuitry configured to:

receive the visual image; and process the visual image to determine an identification of the at least one object; and appliance control circuitry configured to:

receive the identification of the at least one object;

alter a log of contents of the interior of the refrigeration appliance according to the identification of the at least one object; and change a function of the refrigeration appliance based on one or more items in the log of the contents of the refrigeration appliance, wherein the function of the refrigeration appliance comprises a function of at least one of a chiller of the refrigeration appliance, a refrigeration compressor of the refrigeration appliance, a circulation fan of the refrigeration appliance, a purification system of the refrigeration appliance, or a filtration system of the refrigeration appliance.

2. The refrigeration appliance system of claim 1 wherein the camera comprises at least four cameras placed in four corners of the door opening of the refrigeration appliance and together configured to capture at least four images including the plane of the door opening and the at least one object as it enters or exits the interior of the refrigeration appliance as it passes through the plane of the door opening while a door of the refrigeration appliance is open.

3. The refrigeration appliance system of claim 1 wherein the object identification circuitry is further configured to determine a volume of a substance within the at least one object or a quantitative number of sub-objects within the at least one object.

4. The refrigeration appliance system of claim 1 wherein the camera further comprises a thermal imaging camera configured to capture a thermal image of the at least one object as it enters or exits the interior of the refrigeration appliance; and wherein the object identification circuitry is further configured to:

receive the thermal image of the at least one object; and process the thermal image to determine a volume of a substance within the at least one object.

5. The refrigeration appliance system of claim 1 wherein the appliance control circuitry is further configured to:

determine that a confidence factor of the identification of the at least one object does not exceed a confidence threshold; and ask a user to identify the at least one object via a user interface.

6. The refrigeration appliance system of claim 5 wherein the user interface comprises a graphical user interface presented to the user via at least one of a display screen on the refrigeration appliance or a mobile user device communicatively coupled to the appliance control circuitry.

7. The refrigeration appliance system of claim 1 wherein the object identification circuitry uses a trained machine learning model to determine the identification of the at least one object.

8. The refrigeration appliance system of claim 1 wherein the appliance control circuitry is further configured to provide a user with the log of the contents.

9. The refrigeration appliance system of claim 1 wherein the appliance control circuitry is further configured to provide a user with a recommendation of an item to replace in the refrigeration appliance.

10. The refrigeration appliance system of claim 1 wherein the appliance control circuitry is further configured to:

determine that a second object has been within the refrigeration appliance longer than a threshold time; and provide a user with an identification of the second object and an indication that the second object has been within the refrigeration appliance longer than the threshold time.

11. The refrigeration appliance system of claim 1 wherein the appliance control circuitry is further configured to provide a user with a recommendation of a location within the refrigeration appliance to store the at least one object.

12. The refrigeration appliance system of claim 11, wherein the appliance control circuitry is further configured to provide the user with the recommendation of the location within the refrigeration appliance by at least one of flashing LEDs within the interior of the refrigeration appliance at a zone corresponding to the location, or changing a color of the LEDs at the zone corresponding to the location.

13. The refrigeration appliance system of claim 1 wherein the camera further comprises a thermal imaging camera configured to capture a thermal image of the at least one object as it enters or exits the interior of the refrigeration appliance; and wherein the object identification circuitry is further configured to:

receive the thermal image of the at least one object; and process the thermal image to determine a quantitative number of sub-objects within the at least one object.

14. A method of identifying an object in a refrigeration appliance, the method comprising:

capturing, by a camera located within an interior of a refrigeration appliance, a visual image of at least a portion of the interior of the refrigeration appliance including a plane of a door opening or the refrigeration appliance and at least one object as it enters or exits the interior of the refrigeration appliance as it passes through the plane of the door opening while a door of the refrigeration appliance is open;

receiving, by object identification circuitry, the visual image;

processing, by the object identification circuitry, the visual image to determine an identification of the at least one object;

receiving, by appliance control circuitry, the identification of the at least one object;

altering, by the appliance control circuitry, a log of contents of the interior of the refrigeration appliance according to the identification of the at least one object; and changing a function of the refrigeration appliance based on one or more items in the log of the contents of the refrigeration appliance, wherein changing the function further comprises changing a function of at least one of a chiller of the refrigeration appliance, a refrigeration compressor of the refrigeration appliance, a circulation fan of the refrigeration appliance, a purification system of the refrigeration appliance, or a filtration system of the refrigeration appliance.

15. The method of claim 14, wherein capturing, by the camera located within the interior of the refrigeration appliance, the visual image of the at least a portion of the interior of the refrigeration appliance and the at least one object as it enters or exits the interior of the refrigeration appliance comprises:

capturing, by at least four cameras placed in four corners of the door opening of the refrigeration appliance, at least four images including the plane of the door opening and the at least one object as it enters or exits the interior of the refrigeration appliance as it passes through the plane of the door opening while a door of the refrigeration appliance is open.

16. The method of claim 14 further comprising:

determining, by the object identification circuitry, a volume of a substance within the at least one object or a quantitative number of sub-objects within the at least one object.

17. The method of claim 16 wherein the camera comprises a thermal imaging camera, and wherein the method further comprises:

capturing, by the camera, a thermal image of the at least one object as it enters or exits the interior of the refrigeration appliance;

receiving, by the object identification circuitry, the thermal image of the at least one object; and determining a volume of a substance within the at least one object or a quantitative number of sub-objects within the at least one object, at least in part, by using the thermal image.

18. The method of claim 14 further comprising using, by the object identification circuitry, a trained machine learning model to determine the identification of the at least one object.

19. The method of claim 14 further comprising:

determining, by the appliance control circuitry, that a confidence factor of the identification of the at least one object does not exceed a confidence threshold; and asking a user, by the appliance control circuitry, to identify the at least one object via a user interface.

20. The method of claim 14 further comprising:

providing to a user, by the appliance control circuitry, the log of the contents of the refrigeration appliance via a user interface; and providing to a user, by the appliance control circuitry, a recommendation of an item to replace in the refrigeration appliance via the user interface.

* * * * *